US006273393B1

(12) United States Patent
McCoy

(10) Patent No.: US 6,273,393 B1
(45) Date of Patent: Aug. 14, 2001

(54) CONCRETE FORM SUPPORT BRACKET AND ASSEMBLY

(76) Inventor: David J. McCoy, 47296 Bell School Rd., East Liverpool, OH (US) 43920

( * ) Notice: Subject to any disclaimer, the term of this patent is extended or adjusted under 35 U.S.C. 154(b) by 0 days.

(21) Appl. No.: 09/224,624

(22) Filed: Dec. 31, 1998

(51) Int. Cl.[7] ..... E04G 17/18
(52) U.S. Cl. ..... 249/219.1; 249/19
(58) Field of Search ..... 249/19, 23, 25, 249/219.1, 24; 52/702, 713, 714

(56) References Cited

U.S. PATENT DOCUMENTS 3,806,074 4/1974 Ward .
3,989,219 11/1976 Pruitt .
4,223,866 9/1980 Black .
4,349,491 * 9/1982 Eyden ..... 249/25
4,856,252 8/1989 Cornell .
5,092,559 3/1992 Tjelle .

* cited by examiner

*Primary Examiner*—Michael Safavi
(74) *Attorney, Agent, or Firm*—Baker & Daniels

(57) ABSTRACT

A concrete form support bracket and assembly which can be used economically and efficiently to pour concrete bridge decks or building floors. The brackets, which are used in pairs, have a base plate to bear the weight of form ledgers, a rear wall extending from the base plate, and a pair of spaced apart side walls extending from the rear wall and base plate. A fastener is provided for securing the ledger in the bracket and an opening is located in the base plate for providing a bolt to support and adjust the bracket. In the assembly form, the bracket may include a hanger bar, receiving channel and adjustable bolt as a support for the bracket.

16 Claims, 6 Drawing Sheets

CONCRETE FORM SUPPORT BRACKET AND ASSEMBLY

BACKGROUND OF THE INVENTION

1. Field of the Invention

This invention relates to the field of supporting assemblies to hold concrete form structures in place to pour concrete floors for bridges and the like, and particularly, to an easily removable, adjustable bracket assembly.

2. Description of the Related Art

Typical form structures for pouring concrete floors for bridges, high rise buildings and the like, comprise ledgers, (sometimes called whalers), which are wooden supports, extending laterally between the bridge beams or floor beams; stringers (or spacers) which are typically wooden boards extending longitudinally across and on the top of the ledgers; and plywood sheets on top of the stringers to provide the floor on which the concrete is to be poured. The ledgers are supported by hanger bolts hanging down from hanger bars laying laterally across the upper surface of the bridge beam or floor beams, having support plates at the lower ends of the hanger bolts bearing against threaded nuts and with end portions of the ledgers resting on the support plates.

RELATED ART

Examples of patents that are related to the present invention are as follows, and each patent is herein incorporated by reference for the supporting teachings:

U.S. Pat. No. 5,092,559 is a concrete form support assembly.

U.S. Pat. No. 4,856,252 is a joist hanger.

U.S. Pat. No. 4,223,866 is an adjustable bracket.

U.S. Pat. No. 3,989,219 is an adjustable means connecting a deck member to a support.

U.S. Pat. No. 3,806,074 is an interior fascia overhang form for concrete and related components, support systems and methods.

The foregoing patents reflect the state of the art of which applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

An example of a related art support assembly is shown in FIG. 1 and FIG. 2. The related art support assembly includes a hanger assembly 10. The hanger assembly includes a hanger bar 22, which spans each I-beam 24. I-beams 24 may be made of concrete, steel or other suitable material. Each hanger bar 22 has a receiving channel 20 affixed to each end. The receiving channel 20 is positioned on an upper corner of I-beam 24 so that a bolt 18 passes through receiving channel 20. A nut 26 is threaded on bolt 18 to prevent bolt 18 from slipping through channel 20. A ledger support plate 25 is threaded onto bolt 18 to support ledgers 12. The bottom surface 13 of ledgers 12 bear on ledger support plate 25. Stringers 14 are laid laterally across ledgers 12 to support plywood decking 16. The concrete floor is poured so that plywood decking 16 serves as the lower form for the floor. The height of the plywood decking 16 can be adjusted by turning a second nut 21 which is permanently affixed to the lower end of bolt 18.

One of the problems with the related art support assemblies shown in FIG. 1 and FIG. 2 is that ledgers 12 must be paired and nailed together. A ledger spacer 23 is placed between each pair of ledgers 12 so that one ledger is on each side of bolt 18. Paired ledgers 12 require a large quantity of wood, which makes them heavy and increases the cost. Paired ledgers 12 are also awkward to assemble and disassemble, thereby creating a safety hazard to workers who must handle them.

A related art bracket assembly 30 has been devised as shown in FIG. 3 that can be used to eliminate the need for double ledgers and stringers. A single ledger 32 is supported in the hanger bracket 34. The position of ledger 32 can be adjusted in the bracket using bolt 36. The ledged is affixed to the bracket during pouring of the concrete by using nails or other securing means in holes 42. The bottom of bracket 34 is spaced away from I-beam 47 by means of a U bracket 49. The U bracket 49 is attached to bracket 34 with pin 44 and key 48. Instead of a hanger bar spanning the top of beam 47, assembly 30 utilizes an L shaped bracket 40 that bears against the top surface 27 of the I-beam.

The problem with the bracket support assembly 30 is that a styrofoam block 41 or block of other suitable material must be used to prevent concrete from covering L bracket 40 and pouring down between the L bracket and ledger 32. Styrofoam block 41 allows the support bracket assembly 30 to be removed after the concrete floor has hardened. However, after the bracket support assembly 30 is removed, a large void remains on the underside of the concrete floor where styrofoam block 41 was positioned. This void must be patched with either concrete or another suitable filler. This process is time consuming and can result in defects or voids as any concrete or filler material must be applied against gravity.

SUMMARY OF THE INVENTION

It is a feature of the invention to provide a concrete form bracket and assembly which can be used economically and efficiently to pour concrete bridge decks or building floors.

An additional feature of this invention is to provide a concrete form bracket for being used in pairs comprised of a base plate for use as a bearing surface of the form ledgers, a pair of spaced apart side walls extending in parallel from rear wall, means for securing the ledger, and an opening in the base plate for providing a means to support and adjust the bracket.

A further feature of the invention is to provide a hanger bar, receiving channel and adjustable bolt as the support means for the bracket. Yet another feature of the invention is to provide the means for securing the ledger as holes in the side plate for securing the ledger with nails to the bracket. The invention resides not in any once of these features, per se, but rather in a particular combination of all of them herein disclosed and claimed and is distinguished from the prior art in this particular combination of all of its structures for the functions specified. Other features of the present invention will become more clear from the following detailed description of the invention, taken in conjunction with the accompanying drawings and claims, or may be learned by the practice of the invention.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Figure 1:
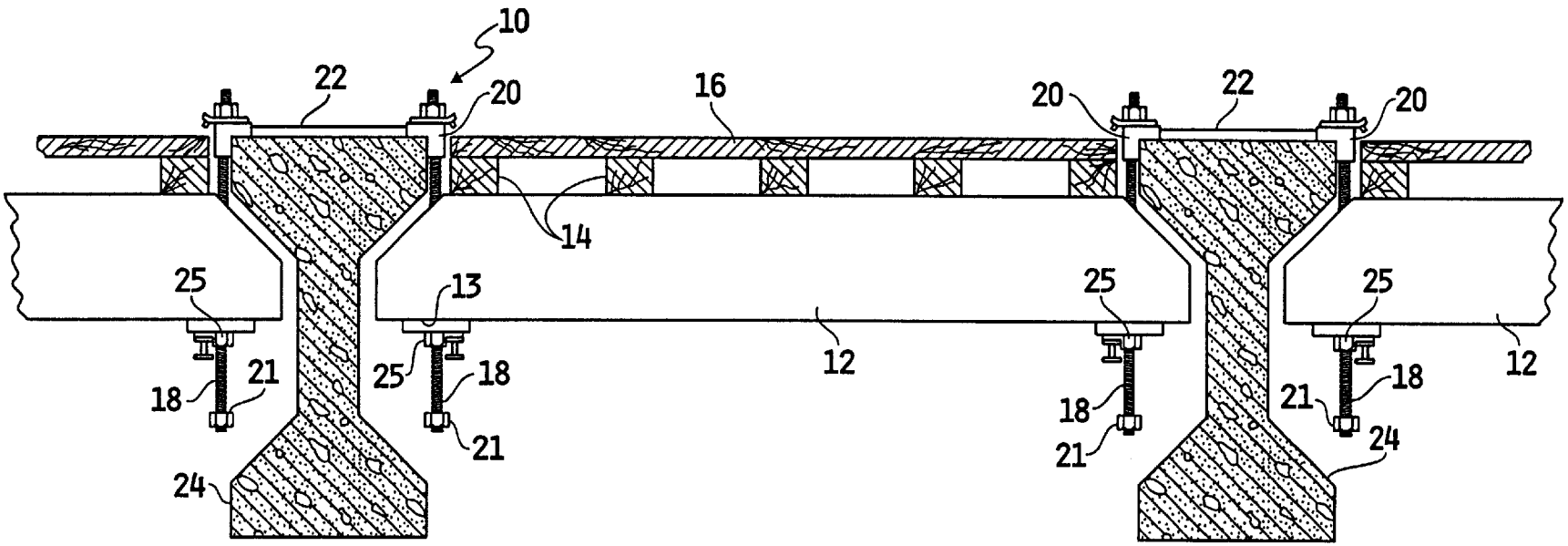
FIG. 1 (RELATED ART)
FIG. 1 and FIG. 2 show a related art concrete form support assembly which utilizes double ledgers and stringer boards to support the plywood deck.
Figure 2:
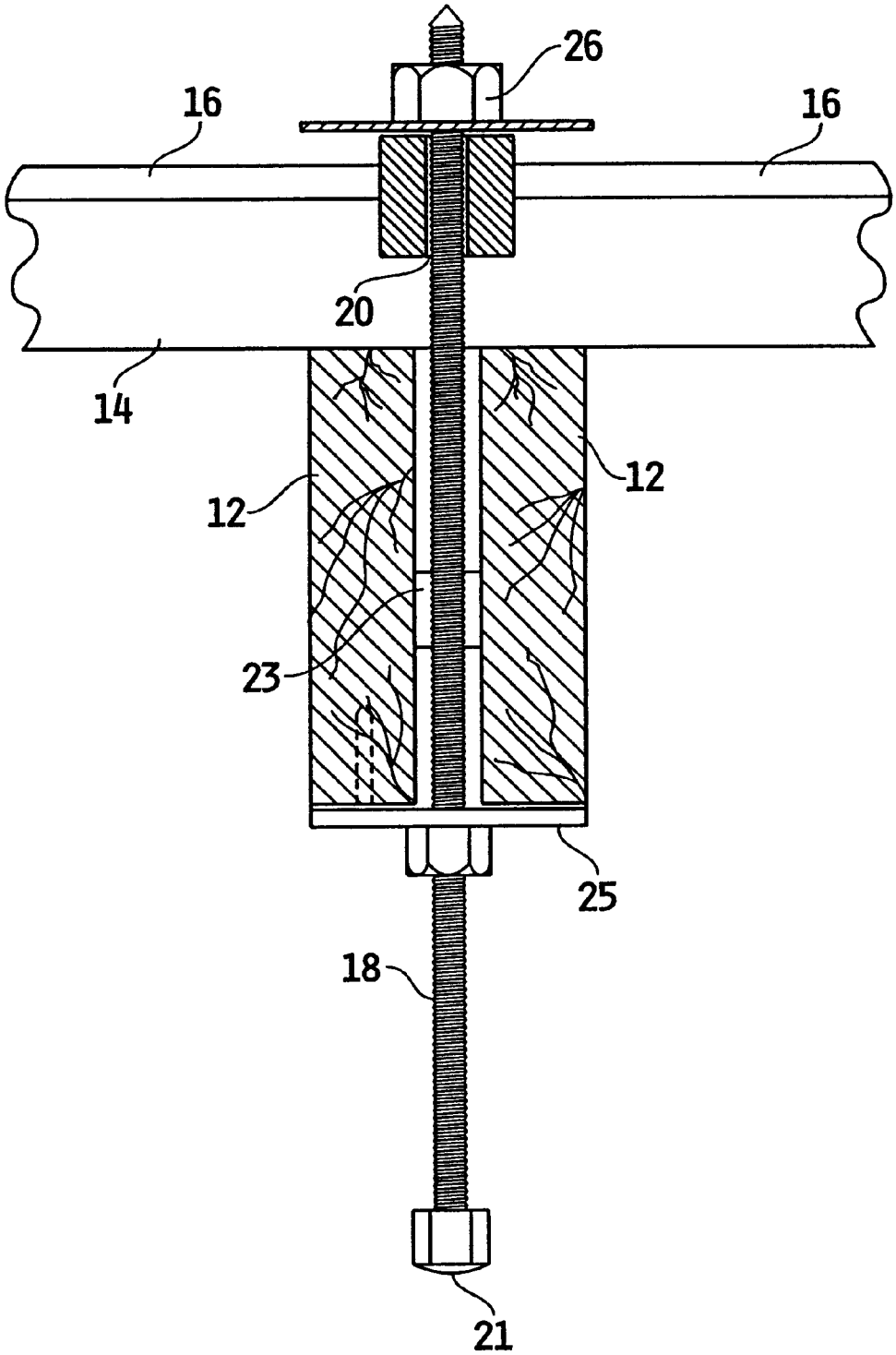
FIG. 2 (RELATED ART)
Figure 3:
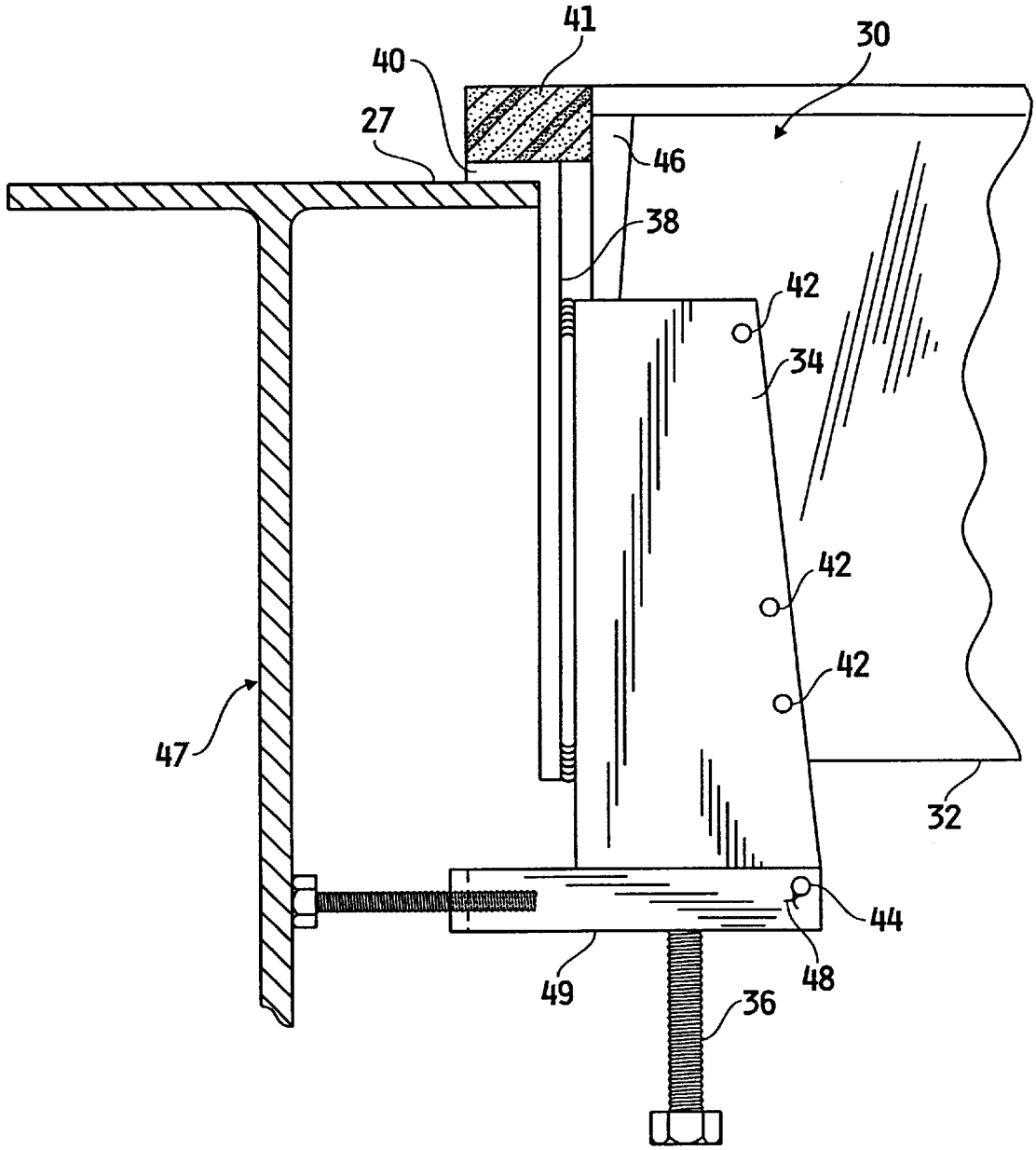
FIG. 3 (RELATED ART)
FIG. 3 depicts a related art adjustable bracket which is supported upon an I-beam using an L shaped plate.

It is noted that the drawings of the invention are not to scale. The drawings are merely schematic representations, not intended to portray specific parameters of the invention. The drawings are intended to depict only typical embodiments of the invention, and therefore, should not be considered as limiting the scope of the invention. The invention will be described with additional specificity and detail through the use of the accompanying drawings. In the drawings, like numbering represents like elements between the drawings.

DETAILED DESCRIPTION OF THE PREFERRED EMBODIMENT

Figure 4:
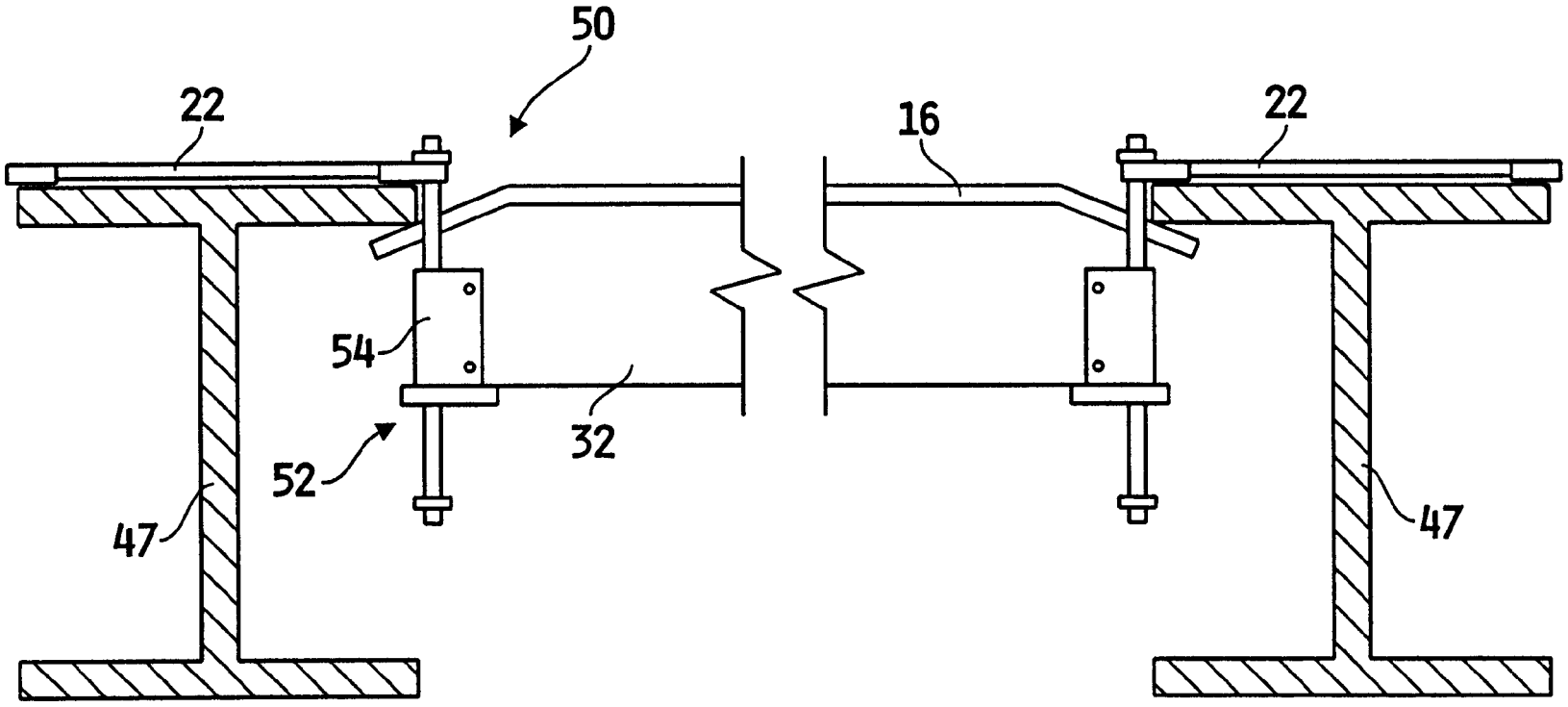
FIG. 4 s a side view of the concrete form support bracket and assembly with the invention shown in place to support a concrete form structure on the beams of a bridge for pouring the concrete floor of the bridge.
Figure 5:
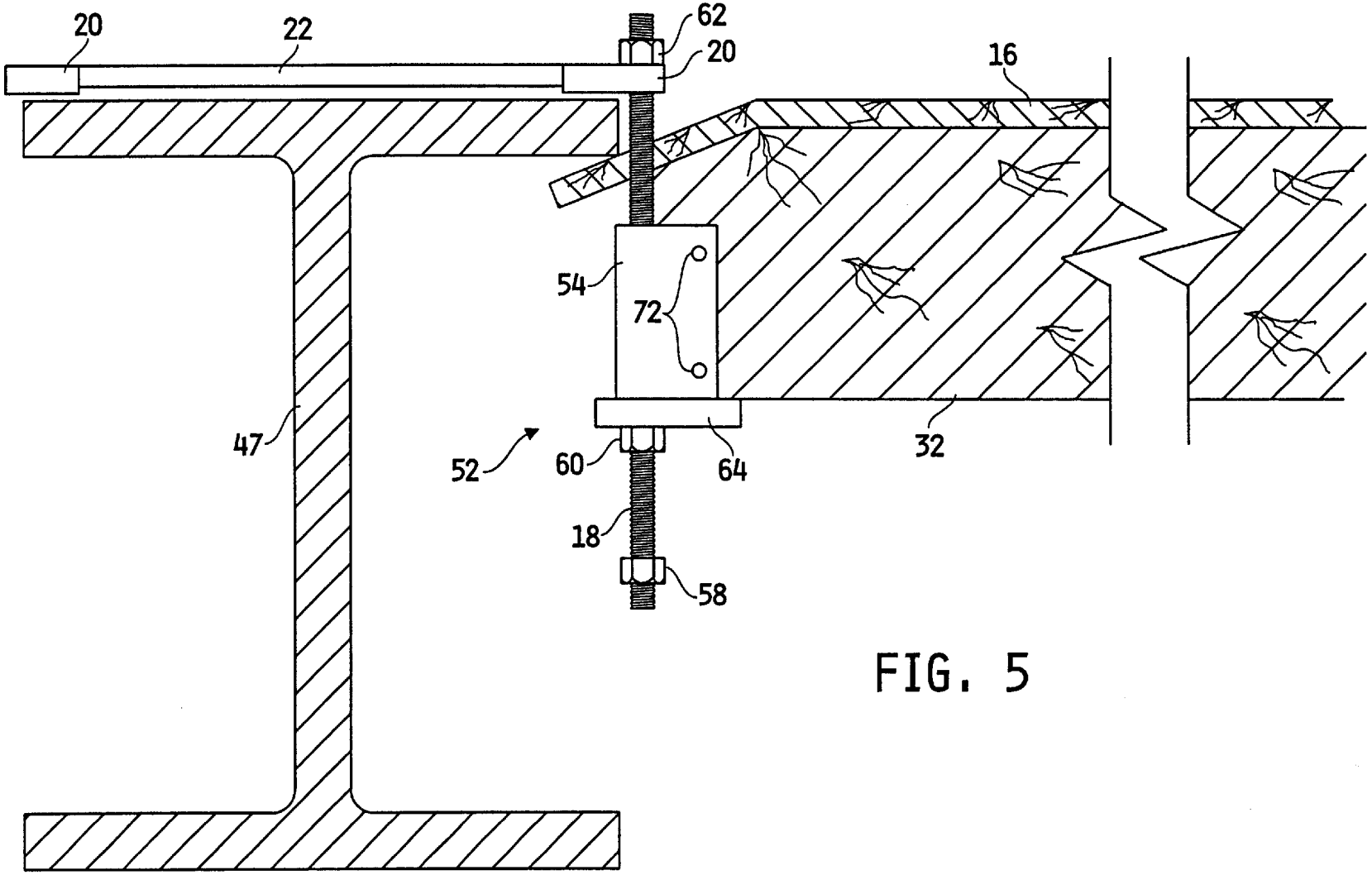
FIG. 5 is an enlarged view of one end of the concrete form support bracket and assembly.

The present invention provides a concrete form support bracket and assembly to support the form structure needed to pour concrete for bridge floors, buildings and other structures. Regarding FIG. 4 and FIG. 5, a typical bridge structure under construction has steel or concrete bridge beams 47, which extend lengthwise or longitudinally in the direction of the roadway it serves. Beams 47 are supported above the span crossed by the bridge by vertically extending bridge support members (not shown). The longitudinal bridge beams 47 are typically spaced apart at approximately six feet in distance.

The typical concrete form decking on which concrete is to be poured to form the floor of the bridge that will be supported by longitudinal bridge beams 47 includes laterally extending wood planks 12 (usually called ledgers or (whalers), extending between adjacent pairs of longitudinal bridge beams 47. In the preferred embodiment, a single wood plank 32 is supported by a pair of concrete form support bracket in assemblies 50. No stringers 14 are required beneath plywood decking 16. Plywood decking 16 will form the base of the concrete floor resting directly on ledgers 32.

The concrete form support assemblies 50 include a pair of bracket support assemblies 52 at each end of every ledger 32. The bracket assembly includes a bracket 54, and a bolt 18 which supports bracket 54 from I-beam 47. Bolt 18 is adjustable and can be used to raise or lower the height of concrete form support assembly 50. The height of the assemblies is adjusted by turning a nut or rotating means/mechanism 58, which is permanently affixed to the bottom of bolt 18, by welding or other means.

When the proper and desired height for the assembly is reached a, nut or securing means/mechanism 60 is snugged against the bottom side of the bracket base 64. The top side of the bracket base 64 provides the bearing surface for ledger 32, which supports plywood deck 16 and the concrete bridge deck which is poured over top.

The upper end of bolt 18 protrudes through a receiving channel 20 and is secured to receiving channel 20 by a nut 62. A hanger bar 22 is affixed to receiving channel 20 and spans the top of I-beam 47 so that another concrete support assembly 50 may be hung from the opposing receiving channel 20 on the opposite end of hanger bar 22. Hanger part 22, receiving channel 20, and nut 62, together serve as a securing means/mechanism for securing the bracket assembly from the beam.

Figure 6:
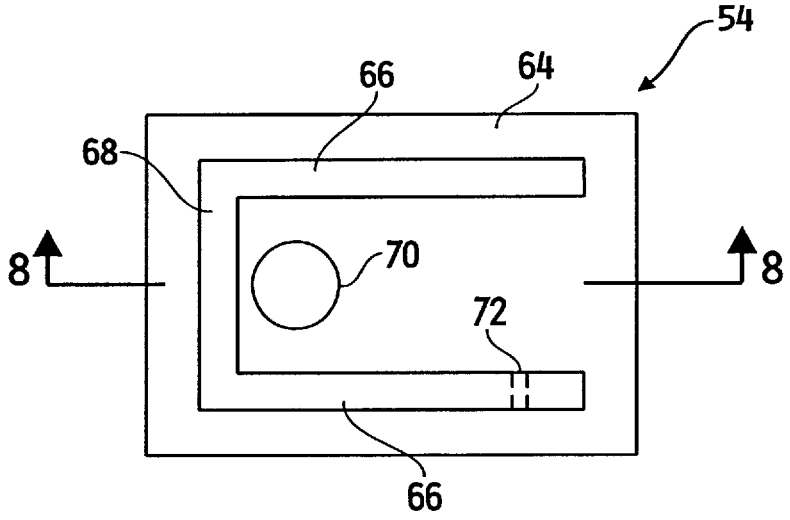
FIG. 6 is a top view of the concrete form support bracket.
Figure 7:
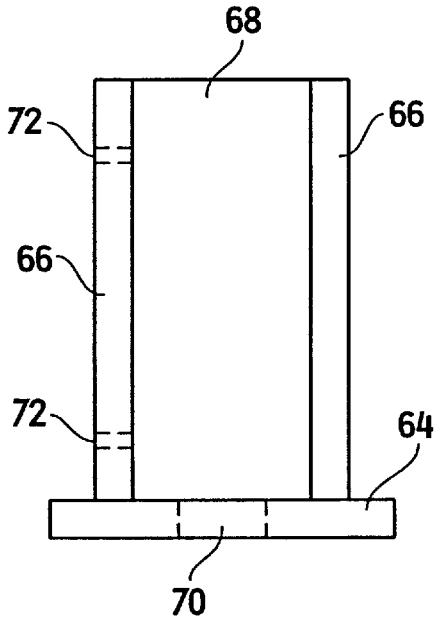
FIG. 7 is a front view of the concrete form support bracket.
Figure 8:
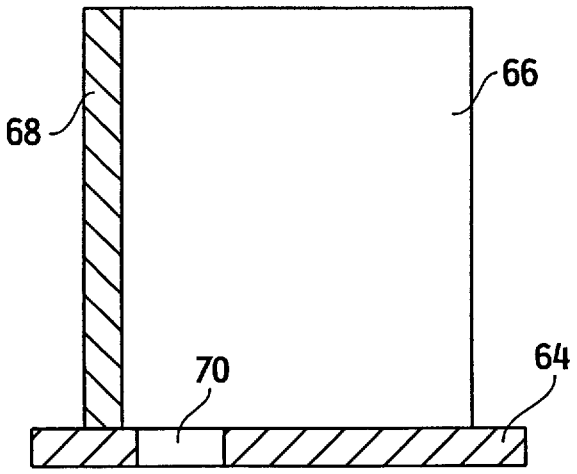
FIG. 8 is a section view taken on line 8—8 of FIG. 6.

As shown in FIG. 6, FIG. 7 and FIG. 8, bracket 54 includes a bracket base 64, two parallel side walls 66, and a rear wall 68 which is permanently affixed to the bracket side wall 66. Bracket rear wall 68 and bracket side wall 66 are also permanently affixed to the top of bracket base 64 by welding or other suitable means. At least one side wall 66 includes openings 72 so that a nail or other securing means may be passed through side wall 66 and into ledger 32 to prevent it from slipping out of bracket 54 before the concrete has been poured and hardened. An opening 70 is provided in bracket base 64 so that bolt 18 may pass through it. Ledger 32 is positioned on the top surface of bracket base plate 64 on the opposite side of opening 70 from bracket rear wall 68.

The concrete form support assembly 50, in accordance with this invention, makes it efficient and safe to remove the concrete formed decking structure after the concrete floor of the bridge has been poured and allowed to harden and cure. Nails or other securing means will be withdrawn from ledger planks 32 in which they were imbedded. A wrench, socket driver and/or power driven socket driver can then be used on nut 58 to unscrew bolt 18 through nut 62. Nut 62 will remain in place as bolt 18 is rotated and nut 62 will be affixed in place by the concrete deck. Prior to pouring the concrete, it is desirable to fill the threads of bolt 18 which are above nut 62 with grease, wax or other substance to prevent the concrete from bonding to the threads. This will facilitate the easy removal of bolt 18 through nut 62. Nut 62, hanger bar 22 and receiving channel 20 will all remain embedded into the concrete deck. These items will not affect the integrity of the concrete structure in any manner. A filler putty may be used to fill the small hole left in the bottom of the concrete deck by the removal of bolt 18. It is not always necessary to fill the void left by bolt 18 with concrete.

Once bolt 18 is removed, ledger 32 can be easily and safely removed and does not pose the dangers incurred by the extra weight of a double ledger 12. Bracket 54 and ledger 32 can then be safely and easily reused when pouring another concrete deck section.

What is claimed and desired to be secured by a United States Patent is:

1. An adjustable concrete form support bracket assembly for being used in pairs as ledger supports, comprising:

a) a bracket for supporting a ledger including:

i. a bracket base for serving as a bearing surface for one end of a ledger, ii. a rear wall permanently affixed to one side of the bracket base and extending laterally therefrom, iii. a pair of spaced apart side walls connected to and extending in parallel from the rear wall and further connected to and extending in parallel from the bracket base, and iv. an opening in the bracket base located adjacent to the rear wall and interposed between the side walls;

b) a bolt extending through the opening in the bracket base;

c) a rotating means for rotating the bolt;

d) a first securing means for securing the bracket assembly from a beam; and e) a second securing means for adjustable securing the bracket at a desired height with respect to a top surface of the beam and position along the length of the bolt.

2. An adjustable concrete form bracket assembly as set forth in claim 1, wherein the rotating means comprises a nut permanently affixed to the lower end of the bolt.

3. An adjustable concrete form support bracket assembly as set forth in claim 1, wherein the first securing means includes;

a) a hanger bar straddling the top of the beam, b) a receiving channel, fixed to one end of the hanger bar, and c) a nut threaded onto an upper end of the bolt and bearing on the receiving channel.

4. An adjustable concrete form support bracket assembly as set forth in claim 1, wherein the second securing means comprises a nut threaded onto the bolt and located beneath the bracket base so that a bottom side of the bracket base bears against said nut.

5. An adjustable concrete form support bracket assembly as set forth in claim 2, wherein the first securing means for securing the bracket assembly comprises:

a) a hanger bar straddling the top of the beam, b) a receiving channel fixed to one end of the hanger bar, and c) a second nut threaded onto an upper end of the bolt and bearing on the receiving channel.

6. An adjustable concrete form support bracket assembly as set forth in claim 2, wherein the second securing means comprises a second nut threaded onto the bolt and located beneath the bracket base so that a bottom side of the bracket base bears against said second nut.

7. An adjustable concrete form support bracket assembly as set forth in claim 3, wherein the second securing means comprises a second nut threaded onto the bolt and located beneath the bracket base so that a bottom side of the bracket base bears against said second nut.

8. An adjustable concrete form support bracket assembly as set forth in claim 5, wherein the second securing means comprises a third nut threaded onto the bolt and located beneath the bracket base so that a bottom side of the bracket base bears against said third nut.

9. An adjustable concrete form support bracket assembly for being used in pairs as ledger supports, comprising:

a) a bracket for supporting a ledger including:

i. a bracket base for serving as a bearing surface for one end of a ledger, ii. a rear wall permanently affixed to one side of the bracket base and extending laterally therefrom, iii. a pair of spaced apart side walls connected to and extending laterally from the rear wall and further connected to and extending laterally from the bracket base;

iv. an opening in the bracket base located adjacent to the rear wall and interposed between the side walls;

b) a bolt extending through the opening in the bracket base;

c) a rotating mechanism for rotating the bolt;

d) a first securing mechanism for securing the bracket assembly from a beam; and e) a second securing mechanism for adiustably securing the bracket at a desired height with respect to top surface of the beam and position along the length of the bolt.

10. An adjustable concrete form bracket assembly as set forth in claim 9, wherein the rotating mechanism comprises a nut permanently affixed to the lower end of the bolt.

11. An adjustable concrete form support bracket assembly as set forth in claim 9, wherein the first securing mechanism for securing the bracket assembly includes:

a) a hanger bar straddling the top of the beam, b) a receiving channel fixed to one end of the hanger bar, and c) a nut threaded onto an upper end of the bolt and bearing on the receiving channel.

12. An adjustable concrete form support bracket assembly as set forth in claim 9, wherein the second securing mechanism comprises a nut threaded onto the bolt and located beneath the bracket base so that a bottom side of the bracket base bears against said nut.

13. An adjustable concrete form support bracket assembly as set forth in claim 10, wherein the first securing mechanism for securing the bracket assembly includes:

a) a hanger bar straddling the top of the beam, b) a receiving channel fixed to one end of the hanger bar, and c) a second nut threaded onto an upper end of the bolt and bearing on the receiving channel.

14. An adjustable concrete form support bracket assembly as set forth in claim 10, wherein the second securing mechanism comprises a second nut threaded onto the bolt and located beneath the bracket base so that a bottom side of the bracket base bears against said second nut.

15. An adjustable concrete form support bracket assembly as set forth in claim 11, wherein the second securing mechanism comprises a second nut threaded onto the bolt and located beneath the bracket base so that a bottom side of the bracket base bears against said second nut.

16. An adjustable concrete form support bracket assembly as set forth in claim 13, wherein the second securing mechanism comprises a third nut threaded onto the bolt and located beneath the bracket base so that a bottom side of the bracket base bears against said third nut.

* * * * *

UNITED STATES PATENT AND TRADEMARK OFFICE

CERTIFICATE OF CORRECTION

PATENT NO. : 6,273,393 B1
DATED : August 14, 2001
INVENTOR(S) : David J. McCoy

It is certified that error appears in the above-identified patent and that said Letters Patent is hereby corrected as shown below:

Claim 1,
Line 5, e) delete "adiustably" and replace with -- adjustably --

Signed and Sealed this

Nineteenth Day of March, 2002

*Attest:*

*Attesting Officer*

JAMES E. ROGAN
*Director of the United States Patent and Trademark Office*